US005776854A

United States Patent [19]

Hayashi

[11] Patent Number: 5,776,854

[45] Date of Patent: Jul. 7, 1998

[54] THERMAL TRANSFER SHEET AND THERMALLY TRANSFERRED IMAGE RECEIVING SHEET

[75] Inventor: Masafumi Hayashi, Tokyo-to, Japan

[73] Assignee: Dai Nippon Printing Co., Ltd., Japan

[21] Appl. No.: 720,770

[22] Filed: Oct. 3, 1996

[30] Foreign Application Priority Data

Oct. 6, 1995 [JP] Japan ..... 7-284352

[51] Int. Cl.[6] ..... B41M 5/035; B41M 5/38

[52] U.S. Cl. ..... 503/227; 156/235; 428/195; 428/690; 428/913; 428/914

[58] Field of Search ..... 8/471; 428/195, 428/913, 914, 690; 156/235; 503/227

[56] References Cited

U.S. PATENT DOCUMENTS 5,006,502 4/1991 Fujimura et al. ..... 503/227

*Primary Examiner*—Bruce H. Hess
*Attorney, Agent, or Firm*—Ladas & Parry

[57] ABSTRACT

There is provided a so-called united-body type thermal transfer sheet in which a thermally transferred image receiving sheet has a proper adhesive property to a thermal transfer film, a proper peeling property and an excellent ink receptivity, and has an excellent stability in coloration quality, and can be colored in colors as required, and in addition, there are obtained a very high visibility of the printings, an excellent transferability of ink and clear printed images.

There is also provided a thermally transferred image receiving sheet which has a proper adhesive property to a thermal transfer film, a proper peeling property, an excellent ink receptivity, and an excellent stability in coloration quality, and permits to be colored in colors as required, and in addition, causes a very high visibility of the printings, an excellent transferability of ink and clear printed images.

8 Claims, 2 Drawing Sheets

THERMAL TRANSFER SHEET AND THERMALLY TRANSFERRED IMAGE RECEIVING SHEET

BACKGROUND OF THE INVENTION

The present invention relates to a thermally transferred image receiving sheet and a thermal transfer sheet, and more specifically to a thermally transferred image receiving sheet and a so-called united-body type thermal transfer sheet which comprises a thermally transferred image receiving sheet in which a receptor layer is formed on a surface of a substrate sheet, and a thermal transfer film in which a heat-fusible ink layer is formed on a surface of a substrate sheet, and wherein the receptor layer of the thermally transferred image receiving sheet is detachably adhered to the heat-fusible ink layer of the thermal transfer film.

There has recently been used a thermal transfer medium in which a thermal transfer system is utilized, in order to print output data from a computer or a word processor.

A thermal transfer film in which the thermal transfer system is utilized, has in general been prepared by coating the surface of a substrate sheet made of a plastic film having a thickness of 3 to 20 μm such as a polyester film and a cellophane film, with a heat-fusible ink comprising a vehicle (mainly comprising a wax) and a coloring agent such as a dye or a pigment mixed therein, to form a heat-fusible ink layer on the surface of the substrate sheet.

When printing is effected on a thermally transferred image receiving sheet with the use of such a conventional thermal transfer film, the thermal transfer film is supplied from a roll thereof, while a continuous or sheet-like thermally transferred image receiving sheet is also supplied, so that the former and the latter are superimposed on each other on a platen. Then, in such a state, heat is supplied to the thermal transfer film from the back side surface thereof by means of a thermal-head to melt the heat-fusible ink layer and transfer it to the thermally transferred image receiving sheet, whereby a desired image is formed.

However, the above-mentioned thermal transfer film cannot be used for example in a thermal printer using a conventional thermal (or heat-sensitive) color-developing (or color-forming) paper, since such a thermal printer is provided with no conveying device for the thermal transfer film due to the fact that a recording paper used in the thermal printer per se forms or develops color on the surface thereof by the action of heat.

In order to solve the above-mentioned problem, there has been proposed a united-body type thermal transfer sheet which comprises a thermal transfer film in which a heat-fusible ink layer is formed on a surface of a substrate sheet, and a thermally transferred image receiving sheet in which a receptor layer is formed on a surface of a substrate sheet made of a paper such as an ordinary plain paper, a synthetic paper or a coated paper, wherein the receptor layer of the thermally transferred image receiving sheet is detachably adhered to the heat-fusible ink layer of the thermal transfer film by means of a temporary adhesive layer formed on the heat-fusible ink layer. In the above-mentioned united-body type thermal transfer sheet, an image is formed on the thermally transferred image receiving sheet by peeling the thermal transfer film from the thermally transferred image receiving sheet after the completion of printing.

In the thermally transferred image receiving sheet of such a united-body type thermal transfer sheet, there are required a proper adhesive property to the thermal transfer film, a proper peeling property and a proper ink receptivity. Materials which are usable as a thermally transferred image receiving sheet, are limited to a certain extent. There may occur problems when an ordinary plain paper as marketed is used as a thermally transferred image receiving sheet of the united-body type thermal transfer sheet without applying any process to the ordinary plain paper.

While there has been a progress in polychromed printings, there has rapidly been increased a demand for thermally transferred image receiving sheets to which coloration was per se applied. When a substrate sheet of an ordinary plain paper to which coloration has merely been applied, is used as a thermally transferred image receiving sheet of the united-body type thermal transfer sheet, there may also occur problems such as instability in coloration quality and insufficient supply of colors contrary to a demand for many kinds of colors as required.

A coloring agent for especially designated color such as a dye or a pigment has conventionally been added to a composition for a heat-fusible ink layer of the thermal transfer film, to make a clear contrast between the thermally transferred image receiving sheet and the printings, thus improving visibility of the printings. The transferability of such a heat-fusible ink layer is however poor under ordinary printing conditions, resulting in occurrence of problems of unclear printings. A large printing energy is therefore required for improving the transferability of the above-mentioned heat-fusible ink layer.

SUMMARY OF THE INVENTION

The first object of the present invention is to provide a so-called united-body type thermal transfer sheet in which the above-mentioned problems can be solved, and the thermally transferred image receiving sheet has a proper adhesive property to the thermal transfer film, a proper peeling property and an excellent ink receptivity, and has an excellent stability in coloration quality, and can be colored in colors as required, and in addition, there are obtained a very high visibility of the printings, an excellent transferability of ink and clear printed images.

The second object of the present invention is to provide a thermally transferred image receiving sheet which can solve the above-mentioned problems, and has a proper adhesive property to the thermal transfer film, a proper peeling property, an excellent ink receptivity, and an excellent stability in coloration quality, and permits to be colored in colors as required, and in addition, causes a very high visibility of the printings, an excellent transferability of ink and clear printed images.

In order to achieve the first object of the present invention, a thermal transfer sheet of the present invention comprises:

a thermal transfer film comprising a first substrate sheet and a heat-fusible ink layer formed on one surface of the first substrate sheet; and a thermally transferred image receiving sheet comprising a second substrate sheet and a receptor layer formed on one surface of the second substrate sheet, the receptor layer containing resin and at least one organic fluorescent pigment, the receptor layer of the thermally transferred image receiving sheet being detachably adhered to the heat-fusible ink layer of the thermal transfer film.

The above-mentioned resin of the receptor layer preferably comprises a latex.

The above-mentioned latex preferably has a glass transition temperature (Tg) of from −20° C. to 30° C.

The above-mentioned receptor layer of the thermally transferred image receiving sheet may be caused to be detachably adhered to the heat-fusible ink layer of the thermal transfer film by means of an adhesive property of the heat-fusible ink layer.

The above-mentioned thermal transfer sheet may further comprise a temporary adhesive layer arranged between the receptor layer of the thermally transferred image receiving sheet and the heat-fusible ink layer of the thermal transfer film, for causing the receptor layer to the heat-fusible ink layer.

The above-mentioned thermal transfer sheet may further comprise a matting layer arranged between the first substrate sheet of the thermal transfer film and the heat-fusible ink layer thereof.

The above-mentioned thermal transfer sheet may further comprise a slip layer formed on the other surface of the first substrate sheet of the thermal transfer film.

In order to achieve the second object of the present invention, a thermally transferred image receiving sheet of the present invention comprises:

a substrate sheet and a receptor layer formed on one surface of the substrate sheet, the receptor layer containing resin and at least one organic fluorescent pigment.

DESCRIPTION OF THE PREFERRED EMBODIMENTS

The present invention will be described hereinbelow with reference to the accompanying drawings.

Figure 1:
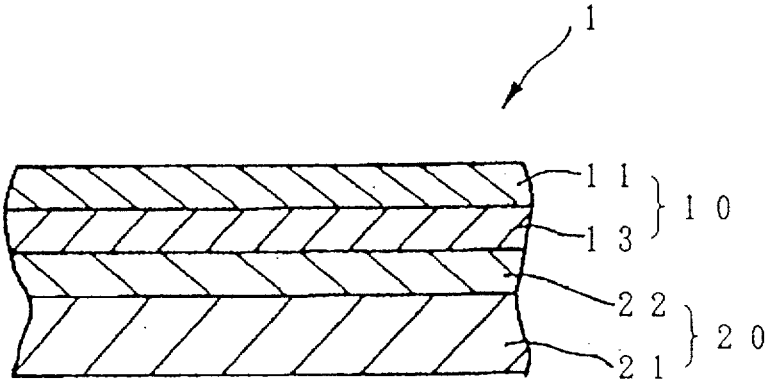
FIG. 1 is a schematic sectional view illustrating a thermal transfer sheet of the first embodiment of the present invention.
Figure 2:
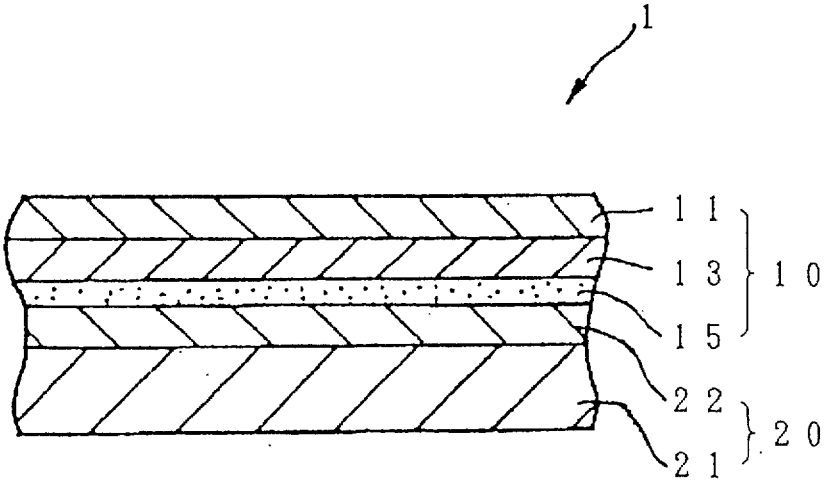
FIG. 2 is a schematic sectional view illustrating a thermal transfer sheet of the second embodiment of the present invention.
Figure 3:
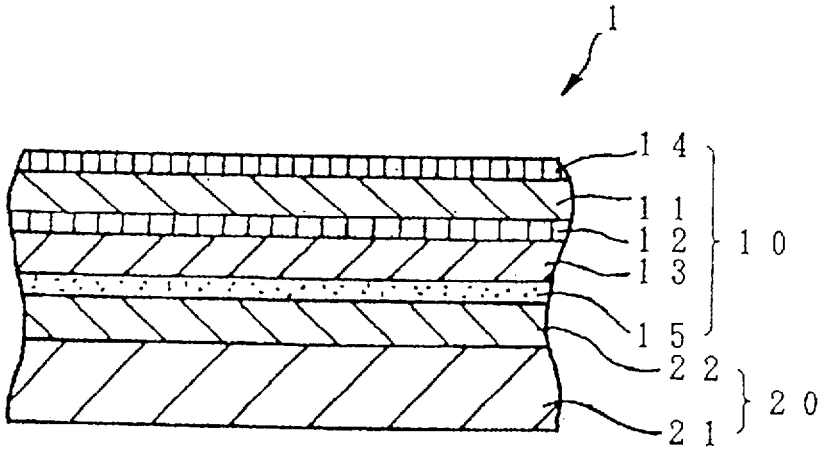
FIG. 3 is a schematic sectional view illustrating a thermal transfer sheet of the third embodiment of the present invention.

Preferred embodiments of the thermal transfer sheet 1 of the present invention are shown in FIGS. 1 to 3. In these FIGS. 1 to 3, the thermal transfer sheet 1 is a so-called united-body type thermal transfer sheet in which a thermal transfer film 10 is detachably adhered to a thermally transferred image receiving sheet 20. The united-body type thermal transfer sheet 1 has a shape as a finished product, in which the thermal transfer film 10 and the thermally transferred image receiving sheet 20 are coiled into a roll (i.e., a co-wound roll).

The united-body type thermal transfer sheet of the first embodiment of the present invention as shown in FIG. 1 has the simplest construction. The thermal transfer film 10 of the united-body type thermal transfer sheet 1 comprises a substrate sheet (i.e., the first substrate sheet) 11 and a heat-fusible ink layer 13 formed on one surface of the substrate sheet 11. The thermally transferred image receiving sheet 20 of the united-body type thermal transfer sheet 1 comprises a substrate sheet (i.e., the second substrate sheet) 21 and a receptor layer 22 formed on one surface of the substrate sheet 21. The thermal transfer film 10 and the thermally transferred image receiving sheet 20 are detachably adhered to each other so that the heat-fusible ink layer 13 of the former is in contact with the receptor layer 22 of the latter.

The united-body type thermal transfer sheet 1 of the second embodiment of the present invention is shown in FIG. 2. In the second embodiment of the present invention, a temporary adhesive layer 15 is formed on the heat-fusible ink layer 13 of the thermal transfer film 10, in addition to the components of the united-body type thermal transfer sheet 1 of the above-mentioned first embodiment of the present invention.

The united-body type thermal transfer sheet 1 of the third embodiment of the present invention is shown in FIG. 3. In the third embodiment of the present invention, a matting layer 12 is formed between the substrate sheet 11 of the thermal transfer film 10 and the heat-fusible ink layer 13 thereof, and a slip layer 14 is formed on the other surface of the substrate sheet 11 of the thermal transfer film 10, in addition to the components of the united-body type thermal transfer sheet 1 of the above-mentioned second embodiment of the present invention.

The components of the united-body type thermal transfer sheets of the first to third embodiments of the present invention will be described in detail hereinafter.

[Substrate sheet]

The same substrate sheet as that used in the conventional thermal transfer film may be used as the substrate sheet 11 to be used in the thermal transfer film 10 of the present invention. However, the substrate sheet 11 is not restricted to such a conventional substrate sheet, but may also be another substrate sheet.

Specific examples of the preferred substrate sheet 11 may include sheets or films comprising plastics such as polyester, polypropylene, cellophane, polycarbonate, cellulose acetate, polyethylene, polyvinyl chloride, polystyrene, nylon, polyimide, polyvinylidene chloride, polyvinyl alcohol, fluororesin, chlorinated rubber, and ionomer resins; papers such as condenser papers and paraffin papers; and nonwoven fabric. The substrate sheet may comprise a composite or laminate of two or more species selected from the above-mentioned constituents.

The thickness of the substrate sheet may appropriately be changed corresponding to the material constituting it so as to provide suitable strength and thermal conductivity thereof. The substrate sheet preferably has a thickness of from 2 to 25 μm.

[Heat-fusible ink layer]

The heat-fusible ink layer formed on the above-mentioned substrate sheet 11 comprises a coloring agent and a binder as main constituents, and may also contain various additives, as desired.

As a matter of course, for the purpose of black monocolor printing, the coloring agent contained in the heat-fusible ink layer 13 may preferably comprise carbon black. Of the known organic or inorganic pigments, there can also preferably be used the pigment having good characteristics for recording materials, for example, the pigment which has a sufficient shade of a color and does not easily tend to discolor or fade by the action of light and/or heat. There can also be used a substance which is achromatic under the non-heated condition, while a color is developed under the heated condition, or a substance in which a color is developed by coming into contact with a material applied to a member to which an image is to be transferred.

For the purpose of multi-color printing, there may be used as a coloring agent one appropriately selected from chromatic pigments or dyes such as yellow pigment, magenta pigment and cyan pigment. With respect to the coloring agent to be used in the heat-fusible ink layer 13, there should be selected a coloring agent having a different hue from that of the receptor layer 22 of the thermally transferred image receiving sheet 20.

Such coloring agents are preferably added to a composition for the heat-fusible ink layer in an amount of from about 1 to about 70 wt. % relative to a solid content of the composition for the heat-fusible ink layer.

Thermally conductive substances may be added to the composition for the heat-fusible ink layer so as to impart excellent thermal conductivity and thermal transferability to the heat-fusible ink layer. As these substances, there may be used carbonaceous substances such as carbon black, aluminum, copper, tin oxide, molybdenum disulfide and the like.

The binder to be contained in the heat-fusible ink layer 13 may predominantly comprise a wax, or may comprise a mixture of the wax and another components such as drying oil, resin, mineral oil, derivatives of cellulose and rubber.

Representative examples of the wax may include microcrystalline wax, ester wax, carnauba wax, paraffin wax and the like. In addition, specific examples of the wax may include various species thereof such as Fischer Tropsch wax, various low-molecular weight polyethylene, Japan wax, beeswax, whale wax, insect wax, lanolin, shellac wax, candelilla wax, petrolactam, partially modified wax, fatty acid ester and fatty acid amide. It is also possible to add one or more species of many kinds of known thermoplastic resins in the above-mentioned wax.

The heat-fusible ink layer 13 preferably include a thermoplastic elastomer having a rubber-like elasticity, for the purpose of increasing the membrane strength of the heat-fusible ink layer 13, imparting adhesive property thereto, and improving the cohesive property thereof. Representative examples of the thermoplastic elastomer having the rubber-like elasticity may include ethylene-vinyl acetate copolymers, synthetic rubber such as butadiene rubber, styrene-butadiene rubber, nitrile rubber, nitrile-butadiene rubber, acrylonitrile-butadiene rubber, high-styrene rubber, isoprene rubber and acrylic rubber, and natural rubber.

Of the above-mentioned thermoplastic elastomers, ethylene-vinyl acetate copolymers, styrene-butadiene or acrylonitrile-butadiene rubber is preferably used in view of excellent printing characteristics. Addition of such a thermoplastic elastomer to the composition for the heat-fusible ink layer 13 in an amount of from 1 to 50 wt. % relative to a solid content thereof produces its fundamental prescribed effect. With an amount of from 5 to 40 wt. %, a better effect may be provided. With an excessively small amount of under 1 wt. % of the thermoplastic elastomer, it is impossible to impart a sufficient coagulative property to the heat-fusible ink layer 13, resulting in occurrence of problems of poor printings. With an excessively large amount of over 50 wt. % of the thermoplastic elastomer, on the other hand, the membrane strength of the heat-fusible ink layer 13 becomes too high, resulting in degradation of resolution of printings.

The above-mentioned thermoplastic elastomers having the rubber-like elasticity preferably have tensile strength (JIS K6301) of from at least 1 kg/cm$^2$ to under 100 kg/cm$^2$. With a value of the tensile strength of under 1 kg/cm$^2$ or at least 100 kg/cm$^2$, printing quality is degraded.

In addition, the thermoplastic elastomers having the rubber-like elasticity preferably have a glass transition temperature (Tg) of from −10° C. to 40° C. With a glass transition temperature (Tg) of under −10° C., adhesion of the heat-fusible ink layer 13 to the substrate sheet 11 becomes too firm, resulting in difficulty in the peeling of the substrate sheet 11 from the heat-fusible ink layer 13 after completion of the printing. With a glass transition temperature (Tg) of over 400° C., on the other hand, the membrane strength of the heat-fusible ink layer 13 becomes too low, thus leading to occurrence of problems of a so called surface defect, i.e., a phenomenon that non-printing portions of the heat-fusible ink layer 13 which has temporarily adhered to the thermally transferred image receiving sheet 20, also keep being adhered thereto even after completion of the printing.

The heat-fusible ink layer 13 can be formed on the substrate sheet 11 by mixing the binder predominantly comprising the above-described wax with the other necessary constituents to prepare a composition, and applying the thus prepared composition to the substrate sheet 11 by means of a hot-melt coating method as a known general method. With respect to another method, the heat-fusible ink layer 13 can be formed on the substrate sheet 11 by mixing an emulsion obtained by emulsifying or dispersing the binder predominantly comprising the above-described wax in an aqueous medium which may contain an alcohol, with an aqueous dispersion containing a coloring agent and a thermoplastic elastomer to prepare an emulsion ink, and applying the thus prepared emulsion ink to the substrate sheet 11 by means of any one of known forming methods such as a gravure printing method, a screen printing method and a reverse or direct roll coating method with the use of a gravure, and drying same. In general, the thus formed heat-fusible ink layer 13 has a thickness of from 0.3 to 10 μm in a dry condition.

[Matting layer]

A matting layer 12 may be formed between the substrate sheet 11 and the heat-fusible ink layer 13. Reasons therefor will be described hereafter.

In general, thermally transferred images look fine since printings have a glossy surface, whereas printed characters may not easily be read due to the glossy surface. Matted printings may therefore be desired. In this case, it is possible to form the matting layer 12 on the heat-fusible ink layer 13 by dispersing inorganic pigments such as silica, calsium carbonate and carbon black in an appropriate solvent which contains a binder comprising any resin to prepare an aqueous dispersion, applying the thus prepared aqueous dispersion to the heat-fusible ink layer 13, and drying same, in a manner as described in Japanese Patent Application No. S58-208306 whose invention was made by the present inventor.

The matting layer 12 preferably has a thickness of from 0.1 to 10 μm in a dry condition. With a thickness of under 0.1 μm, a sufficient function as a matting layer cannot be obtained. With a thickness of over 10 μm, on the other hand, a large printing energy is undesirably required.

Any one of known forming methods such as a gravure printing method, a reverse roll coating method with the use of a gravure and a roll coating method is applied in order to form the matting layer 12.

[Backing layer]

A slip layer 14 may be formed on the other surface of the substrate sheet 11 in order to prevent a thermal head from being stuck onto the other surface of the substrate sheet 11 and fasilitate the smooth running of the thermal head thereon.

In order to form such a slip layer 14, there may preferably be used a composition obtained by adding a lubricant, a surfactant, inorganic particles, organic particles and/or a pigment to a binder comprising a resin.

Representative examples of the resin to be used as a binder may include cellulosic resins such as ethyl cellulose, hydroxy-ethyl cellulose, hydroxy-propyl cellulose, methyl cellulose, cellulose acetate, cellulose buthyl acetoacetate and nitrocellulose; vinyl resins such as polyvinyl alcohol, polyvinyl acetate, polyvinyl butylal, polyvinyl acetal, polyvinyl pyrrolidon, acrylic resin, polyacrylamide and acrylonitrile-styrene copolymer; polyester resins; polyurethane resins; silicone-modified or fluorine-modified urethane resins; melamine resins and urea resins.

There may preferably be used a bridged resin obtained by mixing any resin having several reactive groups, for example, hydroxyl groups, of the above-mentioned resins, with a cross-linking agent comprising polyisocyanate.

The slip layer 14 can be formed on the other surface of the substrate sheet 11 by dissolving or dispersing materials in an appropriate solvent, which have been obtained as mentioned above by adding the lubricant, the surfactant, the inorganic particles, the organic particles and/or the pigment to the binder comprising the above-mentioned resin, to prepare a composition, applying the thus prepared composition to the other surface of the substrate sheet 11 with the use of any one of the conventional means such as a gravure coater, a roll coater and a wire bar, and drying same.

The slip layer 14 preferably has a thickness of from 0.01 to 10 μm in a dry condition.

Now, the thermally transferred image receiving sheet 20 to be united with the thermal transfer film 10 into one body will be described hereafter.

The thermally transferred image receiving sheet 20 used in the present invention comprises a substrate sheet 21 and a receptor layer 22 formed on the substrate sheet 21 as shown in FIGS. 1 to 3.

[Substrate sheet]

Representative examples of material for forming the substrate sheet 21 may include synthetic paper such as polyolefin paper and polystyrene paper; many kinds of paper such as fine paper, art paper, coated paper, cast-coated paper, wallpaper, backing paper, synthetic resin-impregnated paper, emulsion-impregnated paper, synthetic rubber-latex-impregnated paper, paper backed with synthetic resin and paperboard; and transparent or opaque plastic material such as polyester, polyvinyl chloride, polyvinylidene chloride, polyurethane, polyvinyl alcohol, polypropylene, polyethylene, polystyrene, ethylene-vinyl acetate copolymers, ethylene-acrylic ethyl copolymers, ethylene-acrylic copolymers, methylpentene polymers, polyimide, polyamide and fluororesin. However, material for forming the substrate sheet 21 is not especially limited to the above-mentioned materials. As the substrate sheet 21, there may be used a white opaque film or a foamed sheet which is formed with the use of a mixture of at least one of these plastic materials with a white pigment and a filler. As the substrate sheet 21, there may also be used a transparent plastic film which is used for a conventional overhead projector (OHP).

The substrate sheet 21 may comprise a laminated body of the combination of optionally selected materials. In this case, representative examples thereof may include a laminated body of cellulose fiberpaper and synthetic paper, and another laminated body of cellulose fiberpaper and a plastic film.

The above-mentioned substrate sheet 21 has a thickness of from 25 to 500 μm, and preferably a thickness of from 50 to 150 μm, although such a thickness depends on a material and method for the formation thereof.

[Receptor layer]

The receptor layer 22 is formed on the above-mentioned substrate sheet 21. The receptor layer 22 receives ink transferred from the above-described heat-fusible ink layer 13. The receptor layer 22 contains resin and at least one organic fluorescent pigment as a coloring agent.

Representative examples of material for forming the receptor layer 22 may include resin having an excellent ink fixation, such as ethylene-vinyl acetate copolymers; vinyl chloride-vinyl acetate copolymers; acrylic copolymers such as acrylonitrile-butadiene rubber and styrene-acrylate; polyester; polyvinyl alcohol; polyurethane; styrene-butadiene rubber; acrylic resin; processed natural resin; and petroleum resin. As the material for forming the receptor layer 22, there may be used wax as carnauba wax, paraffin wax and the like.

The mixing ratio of the organic fluorescent pigment and other resin or wax for forming the receptor layer 22 may preferably be 10 0.1–20. Of the resins, a latex having the rubber-like elasticity, i.e., nitrile butadiene rubber (NBR), styrene butadiene rubber (SBR) or the like may preferably be used. In the present invention, the "latex" means an aqueous solution in which synthetic rubber such as NBR, SBR, or the like is dispersed. There may preferably be used a latex having an excellent cohesive property, and a glass transition temperature (Tg) of from −20° C. to 30° C. Because, with a glass transition temperature (Tg) of under −20° C., the receptor layer 22 is excessively softened, resulting in occurrence of the so called surface defect, i.e., the phenomenon that non-printing portions of the heat-fusible ink layer 13 which has temporarily adhered to the thermally transferred image receiving sheet 20, also keep being adhered thereto even after completion of the printing. With a glass transition temperature (Tg) of over 30° C., on the other hand, the receptor layer 22 is excessively hardened, resulting in degradation of the ink receptivity thereof.

In the further preferable embodiment, it is possible to maintain a proper function of the united-body type thermal transfer sheet for a long period of time by adding nitrocellulose or polyamide, which has a glass transition temperature (Tg) of at least 60° C., to the above-mentioned resin having an excellent ink fixation in an amount of from 10 to 300 weight parts relative to this resin of 100 weight parts.

The organic fluorescent pigment contained in the receptor layer 22 is utilized for the fluorescent coloration of the thermally transferred image receiving sheet 20. This organic fluorescent pigment should have a different hue from that of the coloring agent contained in the above-described heat-fusible ink layer 13 so that a clear contrast is made between printed portions and non-printed portions.

The organic fluorescent pigment is quite different from an ordinary pigment in that the former comprises powder of a solid solution of a synthetic resin and a fluorescent dye. However, there exceptionally exists another organic fluorescent pigment, for example, Lumogen pigment, which is not of a solid-solution type, but of a pigment type as in an ordinary organic pigment. However, almost all of such pigment type organic fluorescent substances cannot be put to practical use.

The fluorescent dye has a large reactivity, since it has a chemical structure or an electronic condition in which excitation is easily caused by light. It may be said that the fluorescent dye is an organic compound having extremely unstable property against light. The synthetic resin-solid solution type organic fluorescent pigment has advantageous effect of permitting its application to a certain use to which a dye cannot be applied, while maintaining vivid color of the fluorescent dye. Such a synthetic resin-solid solution type organic fluorescent pigment however has had a relatively low durability against sunlight, and there has conventionally been studied measures to improve the durability against sunlight.

Protection of the fluorescent dye from sunlight is contradictory to the requirement that the fluorescent dye must have a reactive and unstable chemical structure in which excitation is easily caused by light. The production of the fluorescent dye with the use of the synthetic resin-solid solution makes it possible to impart durability against sunlight to an extent that it can be practically used without difficulty.

The synthetic resin-solid solution type organic fluorescent pigment can be produced by uniformly dissolving a fluorescent dye into a transparent rigid matrix. With respect to such a production method, it is well known that there should be noted an interacting force which is produced between the fluorescent dye and the synthetic resin used as a carrier. It is acknowledged that the force interacting between them has a great influence on fluorescence intensity, fluorescent color and durabilities of the fluorescent pigment. In general, the fluorescent pigment fluoresces when the solution for the fluorescent pigment is in a diluted condition, and the fluorescence intensity increases according as the concentration of the solution is increased. The fluorescence intensity decreases when the concentration of the solution is increased over a certain value of concentration. When producing the synthetic resin-solid solution type organic fluorescent pigment, an amount of the fluorescent dye to be added is therefore determined while keeping the balance between the fluorescence intensity and the tinting power.

The organic fluorescent pigment will concretely be described hereafter. Representative examples of the resin used as a carrier of the fluorescent pigment may include acrylic resins, vinyl chloride resins, alkyd resins, aromatic sulfonic amid resins, urea resins, melamine formaldehyde resins, benzoguanamine resins and copolymers thereof, for example, styrene acrylic copolymer resin. Representative examples of the fluorescent dye used in the present invention are shown in Table 1.

TABLE 1

| Dye | Structure | Color in day-light | Fluores-cent color |
|---|---|---|---|
| Brilliant-sulfo-flavine FF (C.I. 56205) | 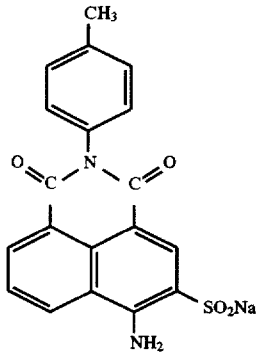 | Yellow | Green \| Yellow-green |
| Basic yellow HG (C.I. 46040) | 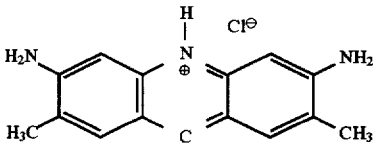 | Yellow | Yellow-green \| Yellow |
| Eosine (C.I. 45380) | 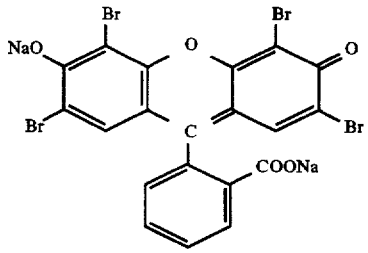 | Red | Red \| Orange |
| Rhodamine 6G (C.I. 45160) | 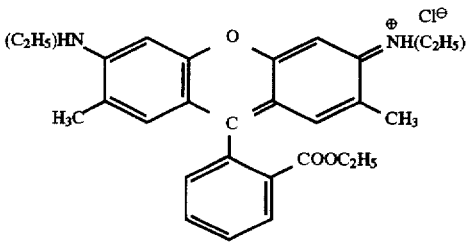 | Red | Yellow \| Orange |

TABLE 1-continued

| Dye | Structure | Color in day-light | Fluores-cent color |
|---|---|---|---|
| Rhodamine B (C.I. 45170) | 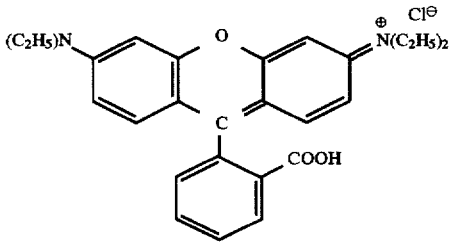 | Pink | Orange \| Red |

Note: Number in parentheses: color index number

There may be used known pigment (yellow, orange, red, violet, blue, green and the like) or pearly luster pigment in order to supplement the tinting power of the above-mentioned organic fluorescent pigment.

The pigment predominantly comprising the the organic fluorescent pigment, which is contained in the receptor layer 22 is used for causing the thermally transferred image receiving sheet 20 to fluoresce and coloring same. An added amount of such a pigment therefore depends upon a kind of pigment to be used. However, the added amount thereof may preferably be within a range of from 5 to 50 wt. %.

The receptor layer 22 has a thickness of from 0.5 to 30 μm in a dry condition. With an excessively small thickness of under 0.5 μm of the receptor layer 22, the fixation of the heat-fusible ink degrades and in addition, an appropriate fluorescence cannot visually be sensed. With an excessively large thickness of over 30 μm of the receptor layer 22, the membrane strength of the receptor layer 22 becomes too low, thus leading to occurrence of problems of a phenomenon that the receptor layer 22 becomes sticky to the thermal transfer film 10, with the result that the receptor layer 22 is removed from the substrate sheet 21 of the thermally transferred image receiving sheet 20, together with the thermal transfer film 10, when the thermal transfer film 10 is attempted to be peeled from the thermally transferred image receiving sheet 20.

The receptor layer 22 can be formed on the substrate sheet 21 of the thermally transferred image receiving sheet 20 by dissolving or dispersing the organic fluorescent pigment and the resin of wax in an appropriate solvent to prepare a composition, applying the thus prepared composition to the other surface of the substrate sheet 21 by means of any one of known forming methods such as a gravure printing method, a screen printing method and a reverse or direct roll coating method with the use of a gravure, and drying same.

A primer layer may preferably be formed between the substrate sheet 21 and the receptor layer 22 in order to improve the adhesive property of the receptor layer 22 to the substrate sheet 21. Representative examples of the material for forming the primer layer may include acrylic resins, polyamide resins, vinyl chloride-vinyl acetate copolymers, polyester resins and urethane resins. The primer layer may be form ed by means of any one of known methods such as a gravure coating, a gravure reverse coating, a roll coating, a knife coating, and the like. The primer layer preferably has a thickness of from 0.1 to 5 μm in a dry condition. A hardening agent and a crosslinking agent may be added to the above-mentioned resin, to increase the membrane strength of the primer layer.

The above-described thermal transfer film 10 and the above-described thermally transferred image receiving sheet 20 are combined into a united body by detachably adhering the heat-fusible ink layer 13 of the thermal transfer film 10 to the receptor layer 22 of the thermally transferred image receiving sheet 20 as shown in FIG. 1. In the thermal transfer sheet of the present invention as shown in FIG. 1, the receptor layer 22 of the thermally transferred image receiving sheet 20 is caused to be detachably adhered to the heat-fusible ink layer 13 of the thermal transfer film 10 by means of the adhesive property of the heat-fusible ink layer 13.

In each of the second and third embodiments of the present invention as shown in FIGS. 2 and 3, a temporary adhesive layer 15 is arranged between the receptor layer 22 and the heat-fusible ink layer 13. The thermal transfer film 10 and the thermally transferred image receiving sheet 20 are detachably adhered to each other into a united body by this temporary adhesive layer 15.

As material for forming the temporary adhesive layer 15, any one of the known adhesives may be used. There may preferably be used a mixture of wax and adhesive resin having a low glass transition temperature, or a mixture of wax and thermoplastic fine particles which keep its shape of particle in a room temperature, and form a membrane under a heated condition, on the other hand.

The above-mentioned temporary adhesive layer 15 may preferably have an adhesive strength of from 300 to 2,000 g. The measurement of the above-mentioned adhesive strength is made by cutting off the united body type thermal transfer sheet into a sample having a width of 25 mm and a length of 55 mm, and measuring the adhesive strength of this sample by the use of a surface friction measurement device (HEIDEN-17, manufactured by NITTO KAGAKU Co. Ltd.) with a drawing speed of 1,800 mm/minute. With an adhesive strength of under 300 g, the adhesion of the thermal transfer film 10 to the thermally transferred image receiving sheet 20 becomes insufficient, with the result that the adhesion of the thermal transfer film 10 is very easily peeled from the thermally transferred image receiving sheet 20 and the thermal transfer film 10 tends to crumple easily. With an adhesive strength of over 2,000 g, on the other hand, non-printing portions of the heat-fusible ink layer 13 which has temporarily adhered to the thermally transferred image receiving sheet 20, also keep being adhered thereto even after completion of the printing, thus causing the so called surface defect, whereas sufficient adhesion of the thermal transfer film 10 to the thermally transferred image receiving sheet 20 is obtained.

The above-mentioned adhesive resin used as the temporary adhesive layer 15 may preferably have a glass transition temperature (Tg) of from −90° C. to −50° C. More specifically, as such an adhesive resin, there may be used rubber-type adhesive resins, acrylic adhesive resins, silicone-type adhesive resins or the like. There may be used any type of these adhesive resins such as a solvent-solute type, an aqueous solution type, a hot-melting type, an aqueous or oleaginous emulsion and the like. As the above-mentioned thermoplastic fine particles which keep its shape of particle in a room temperature, and form a membrane under a heated condition, there may be used polyethylene resins, ionomer resins, ethylene-vinyl acetate copolymers or the like, and such a resin preferably has a minimum temperature of from 50° to 150° C. at which a membrane is formed.

When such an adhesive resin is used alone, an excellent adhesive strength is obtained. However, the peeling-off property of the thermally transferred image receiving sheet 20 however becomes insufficient and ununiform, with the result that unexpected application of force to the thermal transfer sheet during manufacture, storage and transportation thereof may cause the transference of the heat-fusible ink layer 13 of the thermal transfer film 10 to the thermally transferred image receiving sheet 20, thus leading to occurrence of the problem of the so called surface defect. In this case, a cut-out property of the heat-fusible ink layer 13 is degraded, and transference of the heat-fusible ink layer 13 is also made in surrounding portions of a zone to which heat is applied by means of a thermal head, thus leading to degradation of resolution of printed images.

With respect to these problems, it is possible to adjust the adhesive strength within a preferred range so as to solve the above-mentioned problem of the surface defect and to improve the resolution of printed images, by adding an emulsion of the same wax as used for forming the heat-fusible ink layer 13, to the above-mentioned emulsion type adhesive resin.

The weight ratio of the above-mentioned adhesive resin and the wax may preferably be 1:0.5–6. When the weight ratio is outside this range, the above-described unfavorable problems tend to easily occur.

The temporary adhesive layer 15 having the above-described chemical composition may be formed on the surface the receptor layer 20 of the thermally transferred image receiving sheet 20. In this case, a part of the temporary adhesive layer 15 may however remain on the surface the receptor layer 20 of the thermally transferred image receiving sheet 20. It is therefore preferable to form the temporary adhesive layer 15 on the surface of the heat-fusible ink layer 13 of the thermal transfer film 10. In this case, the adhesive resin for the temporary adhesive layer 15 is used in the form of an aqueous emulsion, thus exerting no unfavorable influence on the heat-fusible ink layer 13. With respect to an application method of the emulsion and a drying method thereof, it is possible to utilize an unlimitedly selected one of various kinds of the known methods.

The above-mentioned temporary adhesive layer 15 may preferably have a thickness of from 0.1 to 10 μg (a coating weight in solid content of from 0.05 to 5 g/m$^2$).

The thermal transfer film 10 is put on the thermally transferred image receiving sheet 20 so that the receptor layer 22 of the thermally transferred image receiving sheet 20 comes into contact with the heat-fusible ink layer 13 of the thermal transfer film 10 or the temporary adhesive layer 15 preferably formed on the heat-fusible ink layer 13. The thermal transfer film 10 and the thermally transferred image receiving sheet 20 are then coiled into a co-wound roll, with the result that the thermal transfer film 10 and the thermally transferred image receiving sheet 20 are temporally bonded to each other by means of an adhesive property of the heat-fusible ink layer 13 of the thermal transfer film 10 or the temporary adhesive layer 15 to prepare a united-body type thermal transfer sheet 1. Upon coiling the thermal transfer film 10 and the thermally transferred image receiving sheet 20, any one of them may form an outside layer. The united-body type thermal transfer sheet 1 may be cut into pieces of sheet.

Now, the present invention will be described hereinbelow in more detail with reference to Experiment Examples and Comparative Example. In the description appearing hereinafter, part(s) and % are part(s) by weight and wt.%, respectively, unless otherwise noted specifically.

Experiment Example 1

[Formation of Thermal Transfer Film 10]

A 4.5 μm thick polyethylene terephthalate film of which back surface had been supplied with a slip layer 14, was used as a substrate sheet 11. On the surface (not back surface) of the substrate sheet 11, a matting layer forming composition having the chemical composition described below was applied in a coating amount of 0.5 μm $^2$ (based on solid content), and the resultant coating was dried at 80° to 90° C. to form a matting layer 12.

<Matting Layer Forming Composition>

| | |
|---|---|
| Polyester resin (Biron #200, mfd. by Toyobo K.K.) | 16 parts |
| Carbon black (Diablack, mfd. by Mitsubishi Kagaku K.K.) | 24 parts |
| Dispersing agent | 1.5 parts |
| Hardening agent | 3 parts |
| Methyl ethyl ketone/toluene (wt. ratio 1/1) | 60 parts |

On the thus formed matting layer 12, an ink layer forming composition No. 1 having the chemical composition described below was applied in a coating amount of 4 g/m$^2$ (based on solid content) by a gravure coating method, and the resultant coating was dried at 80° to 90° C. to form a heat-fusible ink layer 13 whereby a thermal transfer film 10 was obtained.

<Ink Layer Forming Composition No. 1>

| | |
|---|---|
| Carbon black (Diablack, mfd. by Mitsubishi Kagaku K.K.) | 10 parts |
| Carnauba wax | 40 parts |
| Acrylonitrile-butadiene rubber (Tg = 4° C.) | 10 parts |
| Ethylene-vinyl acetate copolymer | 10 parts |
| Water | 30 parts |

[Formation of Thermally Transferred Image Receiving Sheet]

A coated paper having a basic weight of 84.9 g/m$^2$ was used as a substrate sheet 21. On the surface of the substrate sheet 21, a receptor layer forming composition having the chemical composition described below was applied in a coating amount of 1.0 g/m$^2$ (based on solid content), and the resultant coating was dried at 50° to 120° C. to form a receptor layer 22, whereby a thermally transferred image receiving sheet 20.

<Receptor Layer Forming Composition>

| | |
|---|---|
| A solution in which an Organic fluorescent pigment was dispersed (color in daylight: yellow; | 10 parts |

-continued

| | |
|---|---|
| 40% in solid content) | |
| An aqueous solution in which polyester resin was dispersed (30% in solid content) (MD-1200, mfd. by Toyobo K.K.) | 10 parts |
| Water | 10 parts |

Then, the receptor layer 22 of the thermally transferred image receiving sheet 20 was detachably adhered to the heat-fusible ink layer 13 of the thermal transfer film 10, whereby a united-body type thermal transfer sheet according to Experiment Example 1, in which there was used the fluorescent pigment having the color of yellow in daylight. The bonding conditions comprised a nip temperature of 50° C. and a nip pressure of 5 kg/cm$^2$.

Experiment Example 2

A united-body type thermal transfer sheet according to Experiment Example 2 was obtained in the same manner as in Experiment Example 1 except that the receptor layer forming composition had the following chemical composition and the coating amount thereof was limited to 3 g/m$^2$ (based on solid content).

<Receptor Layer Forming Composition>

| | |
|---|---|
| A solution in which an Organic fluorescent pigment was dispersed (color in daylight: yellow; 40% in solid content) | 10 parts |
| An aqueous solution in which acrylonitrile-butadiene copolymer resin was dispersed (Tg: −40° C.; 30% in solid content) | 3 parts |
| Water | 10 parts |

Experiment Example 3

A united-body type thermal transfer sheet according to Experiment Example 3 was obtained in the same manner as in Experiment Example 1 except that the receptor layer forming composition had the following chemical composition and the coating amount thereof was limited to 3 g/m$^2$ (based on solid content).

<Receptor Layer Forming Composition>

| | |
|---|---|
| A solution in which an Organic fluorescent pigment was dispersed (color in daylight: yellow; 40% in solid content) | 10 parts |
| An aqueous solution in which styrene-butadiene copolymer resin is dispersed (Tg: 0° C.; 40% in solid content) | 2 parts |
| Water | 10 parts |

Experiment Example 4

A united-body type thermal transfer sheet according to Experiment Example 4 was obtained in the same manner as in Experiment Example 1 except that the receptor layer forming composition had the following chemical composition and the coating amount thereof was limited to 3 g/m$^2$ (based on solid content).

<Receptor Layer Forming Composition>

| | |
|---|---|
| A solution in which an Organic fluorescent pigment was dispersed (color in daylight: pink; 40% in solid content) | 10 parts |

-continued

| | |
|---|---|
| An aqueous solution in which styrene-butadiene copolymer resin is dispersed (Tg: 25° C.; 40% in solid content) | 5 parts |
| Water | 10 parts |

Experiment Example 5

A united-body type thermal transfer sheet according to Experiment Example 5 was obtained in the same manner as in Experiment Example 1 except that the receptor layer forming composition had the following chemical composition and the coating amount thereof was limited to 3 g/m$^2$ (based on solid content).

<Receptor Layer Forming Composition>

| | |
|---|---|
| A solution in which an Organic fluorescent pigment was dispersed (color in daylight: pink; 40% in solid content) | 10 parts |
| An aqueous solution in which styrene-butadiene copolymer resin is dispersed (Tg: 36° C.; 40% in solid content) | 5 parts |
| Water | 10 parts |

Experiment Example 6

A united-body type thermal transfer sheet according to Experiment Example 6 was obtained in the same manner as in Experiment Example 1 except that on the heat-fusible ink layer 13 of the thermal transfer film 10, which was the same as that prepared in Experiment Example 1, a temporary adhesive layer forming composition having the chemical composition described below was applied in a coating amount of 0.5 g/m$^2$ (based on solid content) by a gravure coating method, and the resultant coating was dried at 90° C. to form a temporary adhesive layer 15.

<Temporary Adhesive Layer Forming Composition>

| | |
|---|---|
| Acrylic resin emulsion (40% in solid content) | 20 parts |
| Carnauba wax emulsion (40% in solid content) | 40 parts |
| Isopropyl alcohol/water (2/1) | 40 parts |

A united-body type thermal transfer sheet according to Comparative Example 1 was obtained in the same manner as in Experiment Example 1 except that the thermally transferred image receiving sheet 20 used in Experiment Example 1 was substituted by a color-coated paper having a basic weight of 84.9 g/m$^2$, which was provided with no receptor layer 22.

Each of the united-body type thermal transfer sheets according to Experiment Examples and Comparative Example was set in a facsimile printer, and printing operation was effected by applying energy of 0.3 mj/dot to a thermal head at a temperature of 25° C. and a relative humidity (RH) of 50%. After completion of printing, the thermally transferred image receiving sheet was peeled from the thermal transfer film, to form a desired image on the thermally transferred image receiving sheet. For each of the united-body type thermal transfer sheets according to Experiment Examples and Comparative Example, printing quality and durability of the thus formed image were evaluated in the manner described below.

[Printing Quality Evaluation Method]

Printing operation was effected with the use of the facsimile printer at a temperature of 25° C. and a relative humidity (RH) of 50%. Then, the printing quality of the formed image was evaluated by visual inspection.

Evaluation criteria were as follows:

○: Good

×: Occurrence of printing defect

[Durability Evaluation Method]

The united-body type thermal transfer sheet was coiled into a roll, and the thus coiled united-body type thermal transfer sheet was stored at a temperature of 45° C. and a relative humidity (RH) of 85% for a period of one week. Then, the durability of the united-body type thermal transfer sheet was evaluated by investigating occurrence of surface defect of the receptor layer.

Evaluation criteria were as follows:

○: No occurrence of surface defect

×: Occurrence of surface defect

Evaluation results are shown in Table 2 below.

TABLE 2

| | Printing Quality | Durability |
|---|---|---|
| Experiment Example 1 | ○ | ○ |
| Experiment Example 2 | ○ | ○ |
| Experiment Example 3 | ○ | ○ |
| Experiment Example 4 | ○ | ○ |
| Experiment Example 5 | ○ | ○ |
| Experiment Example 6 | ○ | |
| Comparative Example 1 | X | X |

According to the present invention as described above in detail, it is possible to impart a proper adhesive property to the thermal transfer film, a proper peeling property and an excellent ink receptivity, to the thermally transferred image receiving sheet. Since the receptor layer of the thermally transferred image receiving sheet comprises a resin and an organic fluorescent pigment for coloration, the thermally transferred image receiving sheet has an excellent stability in coloration quality, and can be colored in colors as required.

In addition, since the receptor layer of the thermally transferred image receiving sheet has a chromatic fluorescence, it is possible to make a clear chromatic contrast between the receptor layer and the printed image of the heat-fusible ink, thereby obtaining a very high visibility of the printings, an excellent transferability of ink and clear printed images.

What is claimed is:

1. A thermal transfer sheet which comprises:

a thermal transfer film comprising a first substrate sheet and a heat-fusible ink layer formed on one surface of said first substrate sheet; and a thermally imageable receiving sheet comprising a second substrate sheet and a receptor layer formed on one surface of said second substrate sheet, said receptor layer containing resin and at least one powder of a solid solution of a synthetic resin and a fluorescent dye, said receptor layer of said thermally imageable receiving sheet being detachably adhered to said heat-fusible ink layer of said thermal transfer film.

2. A thermal transfer sheet as claimed in claim 1, wherein:

said resin of said receptor layer comprises a latex.

3. A thermal transfer sheet as claimed in claim 2, wherein:

said latex has a glass transition temperature (Tg) of from −20° C. to 30° C.

4. A thermal transfer sheet as claimed in claim 1, wherein:

said receptor layer of said thermally transferable image receiving sheet is caused to be detachably adhered to said heat-fusible ink layer of said thermal transfer film by means of an adhesive property of said heat-fusible ink layer.

5. A thermal transfer sheet as claimed in claim 1, wherein:

said thermal transfer sheet further comprises a temporary adhesive layer arranged between said receptor layer of said thermally imageable image receiving sheet and said heat-fusible ink layer of said thermal transfer film, for causing said receptor layer to said heat-fusible ink layer.

6. A thermal transfer sheet as claimed in any one of claims 1 to 5, wherein:

said thermal transfer sheet further comprises a matting layer arranged between said first substrate sheet of said thermal transfer film and said heat-fusible ink layer thereof.

7. A thermal transfer sheet as claimed in any one of claims 1 5, wherein:

said thermal transfer sheet further comprises a slip layer formed on an other surface of said first substrate sheet of said thermal transfer film.

8. A thermally imageable receiving sheet comprises:

a substrate sheet; and a receptor layer formed on one surface of said substrate sheet, said receptor layer containing resin and at least one powder of a solid solution of a synthetic resin and a fluorescent dye.

* * * * *